US006311470B1

(12) United States Patent
Rosenwasser et al.

(10) Patent No.: US 6,311,470 B1
(45) Date of Patent: Nov. 6, 2001

(54) REINFORCED SERPENTINE ROPE CHAIN

(75) Inventors: David Rosenwasser; Avram Moshe Rosenwasser, both of Demerest, NJ (US)

(73) Assignee: D&W Jewelry, Inc., New York, NY (US)

( * ) Notice: Subject to any disclaimer, the term of this patent is extended or adjusted under 35 U.S.C. 154(b) by 0 days.

(21) Appl. No.: 09/378,902

(22) Filed: Aug. 23, 1999

(51) Int. Cl.[7] ..... B21L 5/02; F16G 13/00
(52) U.S. Cl. ..... 59/80; 59/35.1; D11/13
(58) Field of Search ..... 59/78, 80, 82, 59/35.1, 16; D11/13

(56) References Cited

U.S. PATENT DOCUMENTS 1,030,215 * 6/1912 Wacker et al. ..... 59/80
4,651,517 * 3/1987 Benhamou et al. ..... 59/80
4,996,835 3/1991 Rozenwasser ..... 59/80

FOREIGN PATENT DOCUMENTS

235980 * 12/1907 (DE) ..... 59/80

* cited by examiner

*Primary Examiner*—David Jones
(74) *Attorney, Agent, or Firm*—Rosenman & Colin, LLP

(57) ABSTRACT

A double spiral jewelry rope chain is formed with thin-walled links which, due to reinforcement, require the use of less amounts of precious metal as compared to conventional chains. In order to reinforce the chain formed by the thin-walled links, a wire of gold or other precious metal is intertwined between the strands of the jewelry chain and permanently affixed to the chain by a fused connection or bond produced by, for example, soldering, welding, brazing and/or by mechanical crimping.

16 Claims, 3 Drawing Sheets

REINFORCED SERPENTINE ROPE CHAIN

BACKGROUND OF THE INVENTION

1. Field of the Invention

The present invention relates in general to decorative chains known as twisted rope chains, and relates in particular to a thin-walled double helix jewelry chain reinforced by a spiral strand of thin wire.

2. Description of Prior Developments

Serpentine chains formed of precious metals such as silver and gold are available in numerous sizes and configurations. Such chains, referred to as twisted rope chains, are formed by a series of interlocked loops or links which are arranged and interconnected in an intertwined spiral or double helix configuration.

Designers of such chains have long sought to reduce the amount of precious metal required in their construction. One approach has been to reduce the wall thickness of the metal used to form the chain links. However, if the thickness of the links becomes too thin, the resulting chain will be weak and highly susceptible to damage and breakage.

Accordingly, a need exists for a decorative chain having thin-walled links yet which has a strength equal to or greater than chains formed with links having thicker walls.

SUMMARY OF THE INVENTION

The present invention has been developed to fulfill the needs noted above and therefore has as an object the provision of a twisted rope chain formed of thin walled links yet which has a strength equal to or greater than chains formed with links having thicker walls.

Another object of this invention is the provision of a twisted rope chain which is reinforced in such a manner that the reinforcement is virtually undetectable to a casual inspection.

Yet another object of the invention is to reduce the cost of decorative spiral chains by reducing the amount of precious metal required to construct the chains.

These and other objects are met by the present invention which is directed to a decorative jewelry chain constructed with links having walls thinner than those previously believed acceptable for adequate chain strength. Each chain is reinforced with one or more reinforcing strands or filaments. These stands or filaments are preferably formed of a precious metal the same as that from which the chain links are constructed, e.g. gold or silver.

At least one solid strand of wire is preferably intertwined with the chain links in a spiral configuration. The wire or wires nest within spiral grooves defined between the individual chains of the double helix twisted rope chain.

The reinforcing wire is permanently connected to the twisted jewelry chain by crimping, soldering, brazing or any other conventional technique. A clasp connector may be permanently attached to one or both ends of the chain to further permanently fix the reinforcing wire to the twisted chain.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawings, like reference characters designate like or similar parts.

DETAILED DESCRIPTION OF THE PREFERRED EMBODIMENTS

The present invention will now be described in conjunction with the drawings, beginning with FIG. 1, which shows a link 10 of known annular shape used in the construction of double helix twisted rope chains. In this example, and for the purpose of illustration, link 10 is a substantially circular or annular link having a small circumferential gap 12 defined between axial end faces 14, 16.

Figure 4:
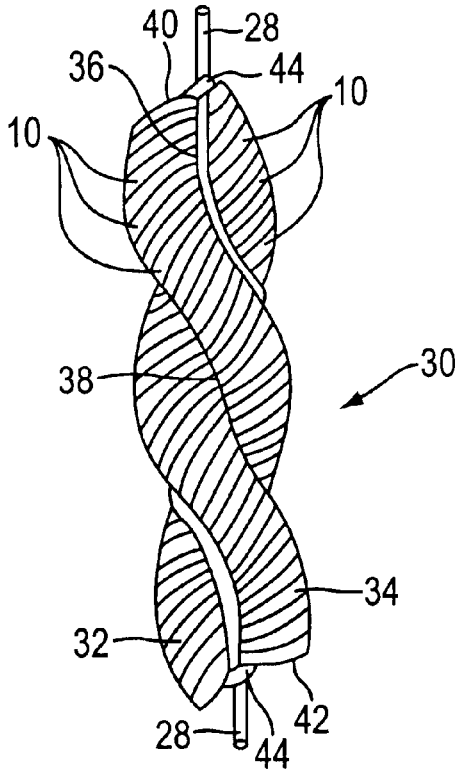
FIG. 4 is a view of a twisted rope chain reinforced with a single reinforcing wire permanently affixed to the chain.
Figure 5:
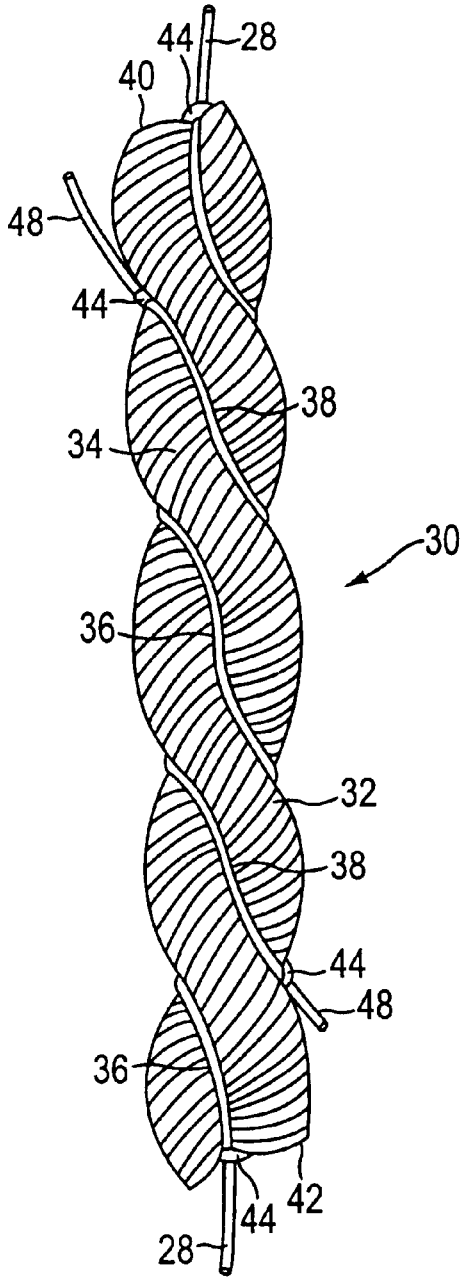
FIG. 5 is a view similar to FIG. 4, but depicting the use of two reinforcing wires permanently braided and affixed to the chain.
Figure 6:
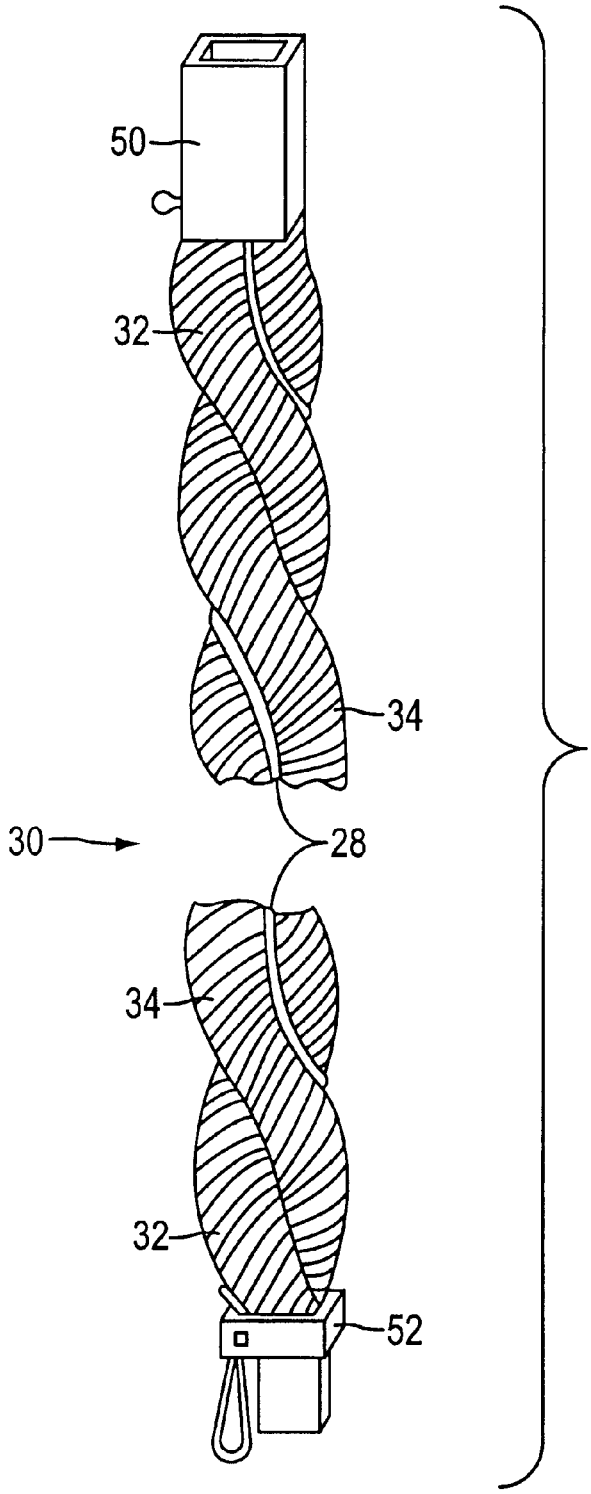
FIG. 6 is a view similar to FIG. 4, with a pair of clasp connectors permanently braided and affixed to the chain.

A series of links 10 may be interconnected in a know fashion to form a double helix twisted rope chain such as shown in FIGS. 4, 5, and 6. An example describing the fabrication of such a chain construction is disclosed in U.S. Pat. No. 4,996,835 which is incorporated herein by reference.

Figure 2:
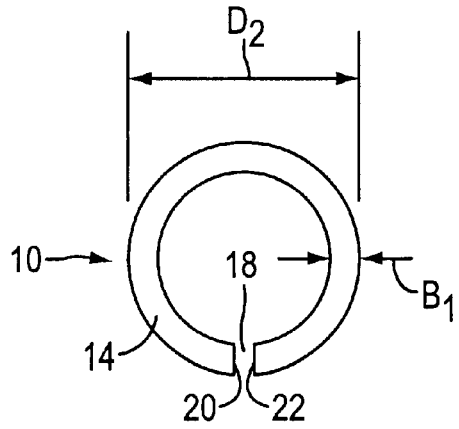
FIG. 2 is an axial end view of the link of FIG. 1, taken along line 2—2 thereof.

Link 10 is formed as a hollow cylinder formed in a loop or ring and having a substantially circular cross section as seen in FIG. 2. A small gap 18 is typically defined between opposed circumferentially-extending circular end faces 20, 22 of the tubular link 10. The gap 18 defines a thin circular open seam around the inner diameter of each link 10.

In order to appreciate the material weight and cost savings possible with the present invention, a weight comparison is set forth below between a chain constructed of chain links formed according to the prior art and a chain constructed of thin wall links formed in accordance with the invention. The basis and ability for the weight savings is the reduction in the link wall thickness, $B_1$, as shown in FIG. 2, and the reinforcement of a chain constructed from a series of such thin-walled links with one or more strands of thin, preferably solid, wire. This type of reinforcement is shown in FIGS. 4 and 5 wherein one and two reinforcing wires 28, 48 are respectively intertwined between the individual strands 32, 34 of a twisted rope chain 30.

Figure 3:
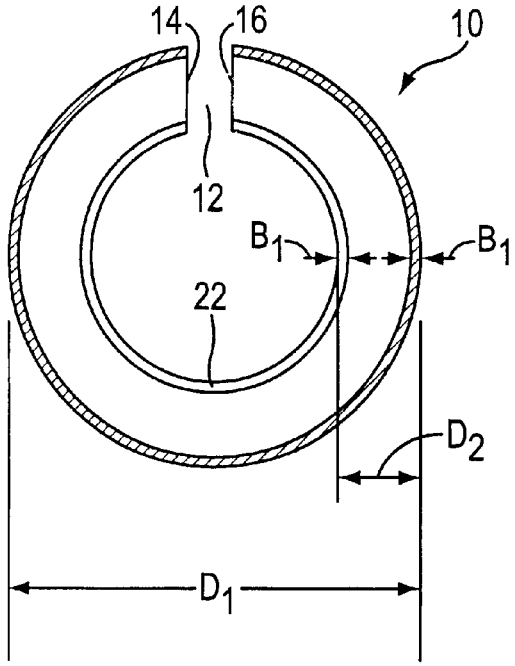
FIG. 3 is a central sectional view of the link of FIG. 1.

The outer diameter $D_1$ of circular chain links 10, as shown in FIG. 3, is typically set at various commercially available sizes, such as 3 mm, 5 mm, 7 mm etc. A weight comparison will be carried out below using a 3 mm link as an example. In order to calculate the weight of a link 10 having a conventional wall thickness, the volume of the tubular link is first calculated for a link having the following dimensions:

$$B_1=0.05 \text{ mm}$$

$$D_1=3.00 \text{ mm}$$

$$D_2=0.60 \text{ mm}$$

To calculate the volume of the link, first calculate the cross sectional area $A_1$ of the link, i.e., the area of face 14 or 16. This area is determined approximately as $$A_1=B_1\times\times D_2$$

This area, $A_1$, is then multiplied by the length L of the link 10, which is approximately equal to $D_1$. The resulting volume V of the link 10 is then:

$$V=A_1\times L=B_1\times\times D_2\times D_1$$

The weight of the link 10 is equal to the product of the density of the link multiplied by its volume. A typical density or equivalent weight per volume of commercially available gold chain link is about 10 grams per cubic mm of link. Thus, the weight of a conventional link 10 is:

$$W=0.05\times3.14\times0.60\times3.14\times3.00\times10$$

$$W=8{,}873 \text{ grams}$$

In order to determine the total number of links N in a chain having a length of one meter, or 1000 mm, the following calculation is used:

$$N=1000 \text{ mm}/D_2=1000 \text{ mm}/0.60 \text{ mm}=1666 \text{ links}$$

The total weight $W_T$ of the chain is then expressed as the product of the number of links N, multiplied by the weight W of each link:

$$W_T=NW$$

In this example:

$$W_T=1666\times8.873 \text{ grams}$$

$$W_T=14{,}782 \text{ grams}$$

The strength S of this chain can be related to the total wall thickness of the two walls in each link 10, which in this example is:

$$S\ B_{1\ +B1}$$

$$S\ 0.05 \text{ mm}+0.05 \text{ mm}$$

$$S\ 0.10 \text{ mm}$$

Next, in accordance with the present invention, a chain link 10 constructed with a thin wall, and a twisted chain formed of a series of such links and reinforced with a twisted wire will be compared with the prior art example and corresponding calculations above. For this example, the wall thickness, $B_1$, of link 10 is reduced from 0.05 mm to 0.03 mm. Thus, for a reduced wall thickness chain link 10 having the following dimensions, the present invention produces a dramatic reduction in weight.

$$B_1=0.03 \text{ mm}$$

$$D_1=3.00 \text{ mm}$$

$$D_2=0.60 \text{ mm}$$

$$W=B_1\times\times D_2\times\times D_1\times10$$

$$W=0.03\times3.14\times0.60\times3.14\times3.00\times10$$

$$W=5.324 \text{ grams}$$

$$W_T=NW$$

$$W_T=1666\times5.324 \text{ grams}$$

$$W_T=8{,}870 \text{ grams}$$

A comparison of the weight of the conventional link chain weight with the weight of the thin walled chain constructed in accordance with the invention yields the following ratio:

$$8{,}870 \text{ grams}/14{,}782 \text{ grams } 40\%$$

As a result of the presence of an intertwined string of metal material provided on the chain, it is possible to reduce the link wall thickness $B_1$ in accordance with the invention yet maintain the strength of the chain to prevent the chain from breaking apart, such as under tensile loading. However, to arrive at a more accurate weight comparison, the weight of the wire must be added to the weight of the chain. This wire weight is approximately equal to the volume of the wire multiplied by its density or weight per unit volume. In this case, the radius of the reinforcing wire 28 is 0.025 mm. The length of this wire is approximately equal to the length L of the chain, i.e. 1000 mm.

The volume V of the wire having a radius R is:

$$V=R^2L$$

$$V=3.14\times0.025\times0.025\times1000 \text{ mm}$$

$$V=1.9625 \text{ mm}^3$$

The weight $W_W$ of the wire is:

$$W_W=V\times10 \text{ grams/mm}_3$$

$$W_W=1.9625\times10=19.625 \text{ grams}$$

If two wires are used, the wire weight is doubled to 39.250 grams. This additional wire weight of about 20 to 40 grams is virtually negligible when compared to the 8,870 grams of the series of chain links. The savings in weight is still approximately 40% over the prior art thick wall chain links.

The strength of the thin-walled chain constructed according to the invention is also related to the wall thickness, B1, as noted above, but is supplemented and increased by the presence of the reinforcing metal wires. If two wires are used to reinforce and strength the chain, the strength of the chain is related to:

$$B_1+B1+2R+2R$$

This results in a relative strength value of:

$$S0.03+0.03+2(0.025)+2(0.025)=0.16$$

The value of 0.16 is substantially greater than that of the thicker walled link, i.e., 0.10.

Accordingly, through the use of wire intertwined between the strands of the twisted chain, thinner walled links can be used with a significant savings in gold or other precious material, but at the same time, the chain can be strengthened to a degree greater than that of chains formed with thicker walled links. In order to hide or camouflage the wire or wires, the wire or wires are preferably formed of the same material as the links, i.e., gold, silver or other precious metal or other metal. Even non metal strands formed of synthetic plastic materials can be used.

Although some chains have used an intertwined wire to aid in the assembly and fabrication of a twisted rope chain, those wires have not been permanently affixed to the chains as in the present invention. Rather, such wires have been removed once the chain links have been interconnected. In contrast, the wire used in constructing twisted rope chains in accordance with the present invention are permanently affixed or attached to the chains to provide increased tensile strength as the chain is displayed, worn and used.

For example, as shown in FIG. 4, a double helix twisted rope chain 30 is shown constructed from two spiral strands

Figure 1:
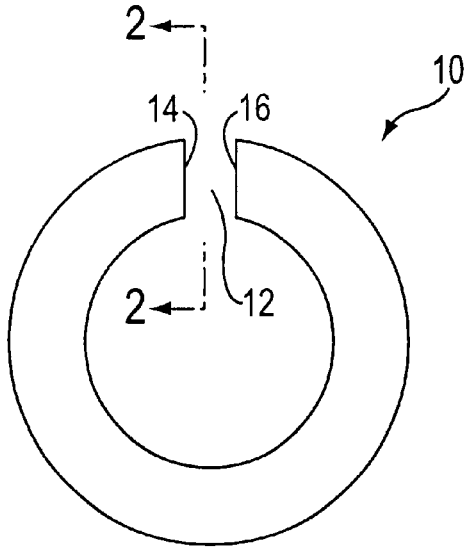
FIG. 1 is a front elevation view of a chain link adapted for use with the invention.

32, 34 each constructed from a series of chain links 10 such as shown in FIG. 1. A single spiral reinforcing wire 28 is tightly wedged between one of the spiral grooves 36, 38 formed between the strands 32, 34. In this example, wire 28 is wedged within groove 36 and permanently affixed to the opposite ends 40, 42 of the chain 30 by, for example, welding, brazing or other types of fused connections 44.

A similar construction is shown in FIG. 5 wherein two spiral wires 28, 48 are respectively wedged or braided within grooves 36, 38 and permanently soldered, welded or brazed to the opposite ends 40, 42 of twisted rope chain 30 at fused connections 44. It should be noted that wires 28, 48 are separated by the two strands 32, 34 of the chain. For each 360 spiral turn in each wire 28, 48, each strand 32, 34 also spirals 360 . Thus the wires have the same pitch as the strands.

The chain 30 of FIG. 4 is shown in FIG. 6 fitted with a pair of clasp members 50, 52 of known construction. The strands 32, 34 and the reinforcing wire 28 are each permanently anchored to each clasp member 50, 52 by a fused bond 44 and/or by mechanical crimping or the like. Of course, the twisted rope chain 30 of FIG. 5 could in the same manner be fitted with the clasp members 50, 52 of FIG. 6.

There has been disclosed heretofore the best embodiment of the invention presently contemplated. However, it is to be understood that the various changes and modifications may be made thereto without departing from the spirit of the invention.

What is claimed is:

1. A decorative rope chain, comprising: a series of intertwined links fitted together one against the other to form in outward appearance a double helix configuration, and defining a first spiral groove and a second spiral groove alternating there between, and a first wire intertwined around said double helix configuration in a first spiral groove location and permanently affixed to said rope chain.

2. The chain of claim 1, wherein said wire is wedged within said first spiral groove location.

3. The chain of claim 1, further comprising a second wire intertwined around said double helix configuration in said second groove location.

4. The chain of claim 3, wherein said second wire is wedged within said second groove location.

5. The chain of claim 4, wherein said second wire is permanently affixed to said chain.

6. The chain of claim 1, further comprising a clasp member mounted on said chain.

7. The chain of claim 1, wherein said first series of chain links comprises gold chain links and wherein said spiral wire comprises a gold wire.

8. The chain of claim 1, wherein said wire is permanently affixed to said chain by a bond.

9. The chain of claim 8, wherein said bond comprises a fused bond.

10. A method of reinforcing a decorative jewelry rope chain formed as a pair of intertwined links forming a double helix configuration, comprising:

intertwining a reinforcing wire with said intertwined links; and permanently affixing said wire to said chain.

11. The method of claim 10, wherein said affixing comprises forming a fused connection between said wire and said chain.

12. The method of claim 11, wherein said fused connection is formed by soldering, brazing, or welding.

13. The method of claim 10, further comprising intertwining a second reinforcing wire with said intertwined links.

14. The method of claim 10, wherein said intertwined links define a pair of alternating spiral grooves and wherein said intertwining further comprises intertwining said wire in one of said spiral grooves.

15. The method of claim 1, further comprising permanently affixing a connector to said chain and said wire.

16. The method of claim 15, wherein said connector comprises a clasp connected to said chain and said wire by soldering, brazing or welding.

* * * * *